US005425254A

United States Patent [19]

Fang-Ping

[11] Patent Number: 5,425,254

[45] Date of Patent: Jun. 20, 1995

[54] DYEING MACHINE WITHOUT ROLLERS

[76] Inventor: Chen Fang-Ping, P.O. Boxs 82-144, Taipei, Taiwan, Prov. of China

[21] Appl. No.: 270,585

[22] Filed: Jul. 5, 1994

[51] Int. Cl.[6] ..... D06B 3/28

[52] U.S. Cl. ..... 68/177

[58] Field of Search ..... 68/177, 178, 18 F

[56] References Cited

U.S. PATENT DOCUMENTS

| | | | |
|---|---|---|---|
| 3,782,138 | 1/1974 | Kawasaki et al. | 68/177 |
| 4,334,333 | 6/1982 | Yamada et al. | 68/177 X |
| 4,587,085 | 3/1986 | Ishimaru | 68/177 X |

FOREIGN PATENT DOCUMENTS

| | | | |
|---|---|---|---|
| 257092 | 6/1988 | German Dem. Rep. | 68/177 |
| 9150 | 3/1985 | Japan | 68/177 |
| 30778 | 7/1985 | Japan | 68/177 |

*Primary Examiner*—Philip R. Coe
*Attorney, Agent, or Firm*—Alfred Lei

[57] ABSTRACT

A dyeing machine without rollers including a circular trough having a neck portion at an upper portion, a tail portion having an upper inlet extending upwardly and then vertically downwardly to form a lower outlet, a large tubular passage connected between a lower portion of the circular trough and the lower outlet of the tail portion, a small tubular passage connected between the neck portion of the circular trough and an upper inlet of the tail portion, a filtering board disposed on a bottom of the large tubular passage, a perforated panel mounted under the filtering board, a reservoir formed at a lower part of the large tubular passage and located under the perforated panel, a branch pipe fitted under the reservoir and communicated therewith, and a pump connected with a lower portion of the circular trough.

1 Claim, 5 Drawing Sheets

DYEING MACHINE WITHOUT ROLLERS

BACKGROUND OF THE INVENTION

It has been found that the conventional dyeing machine utilizes rollers to convey the cloth. However, the speed of the roller can not adapt to the travelling speed of the cloth thereby making the cloth twist together and therefore damaging the surface of the cloth.

Therefore, it is an object of the present invention to provide a dyeing machine without rollers which may obviate and mitigate the above-mentioned drawbacks.

SUMMARY OF THE INVENTION

This invention relates to a dyeing machine without rollers.

It is the primary object of the present invention to provide a dyeing machine without rollers which utilizes cyclic dyeing liquid to move the cloth.

It is another object of the present invention to provide a dyeing machine without rollers which can evenly and rapidly dye the cloth.

It is still another object of the present invention to provide a dyeing machine without rollers which can prevent the cloth from twisting together.

It is still another object of the present invention to provide a dyeing machine without rollers which can make the cloth naturally stack up in the large tubular passage.

It is a further object of the present invention to provide a dyeing machine without rollers which can reduce the required amount of dyeing liquid.

Other objects and merits and a fuller understanding of the present invention will be obtained by those having ordinary skill in the art when the following detailed description of the preferred embodiment is read in conjunction with the accompanying drawings wherein like numerals refer to like or similar parts.

DETAILED DESCRIPTION OF THE PREFERRED EMBODIMENT

Figure 1:
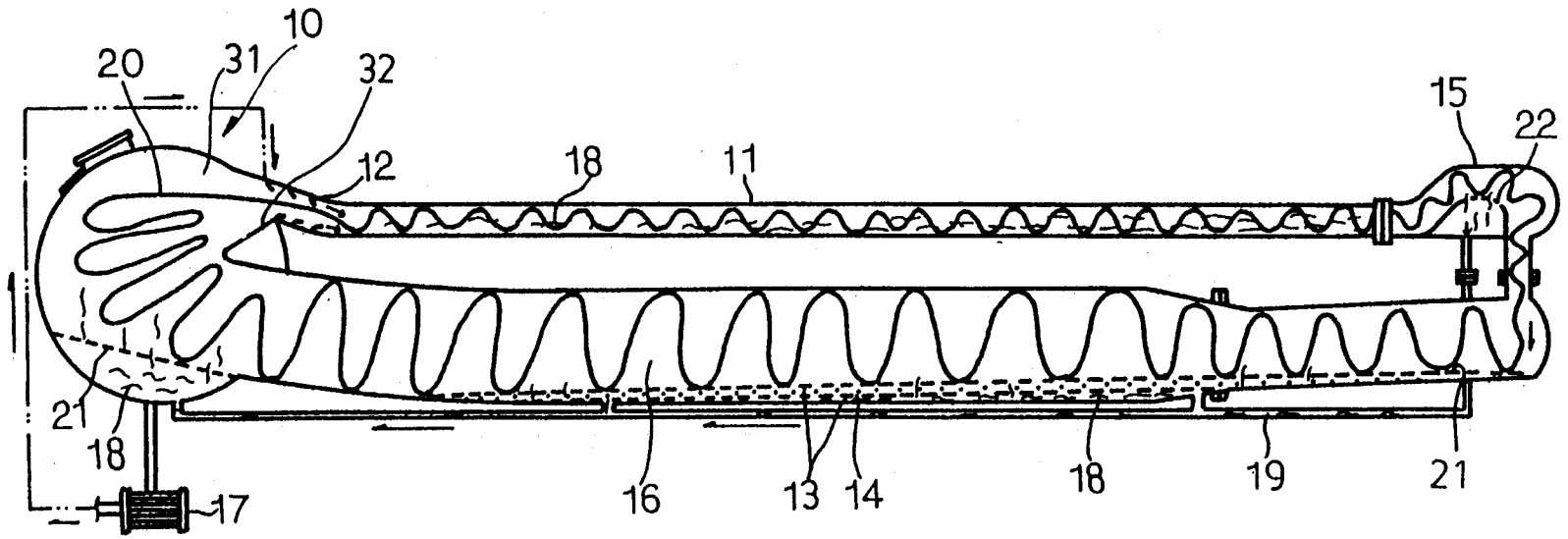
FIG. 1 is a working view of the present invention.

Before explaining the present invention in detail, it is to be understood that the invention is not limited in its application to the details of construction and arrangement of parts illustrated in the accompanying drawings, since the invention is capable of other embodiments and of being practiced or carried out in various ways. Also it is to be understood that the phraseology or terminology employed herein is for the With reference to the drawings and in particular to FIGS. 1 and 2 thereof, the dyeing machine without cyclic rollers according to the present invention mainly comprises a head portion 10, a large tubular passage 16, a small tubular passage 11, and a tail portion 15.

The head portion 10 includes a circular trough 31 formed at the upper portion with a neck portion 32 which is connected with an inlet of the small tubular passage 11. Further, the lower portion of the circular trough 31 is connected with an outlet of the large tubular passage 16. The connection between the large tubular passage 16 and the small tubular passage 11 in the circular trough 31 is formed with an acute portion 32. Hence, the cloth 20 can be easily fed into the small tubular passage 11 through the neck portion 12. Since the neck portion 12 is much smaller than the circular trough 31 in cross section, the dyeing liquid 18 will rush into the small tubular passage 11 thereby rapidly pushing the cloth 20 into the small tubular passage 11 and dyeing the cloth 20 simultaneously. As the cloth 20 is not conveyed by rollers, it is no longer necessary to take friction into consideration and so the cloth 20 will not be damaged any longer.

Figure 2:
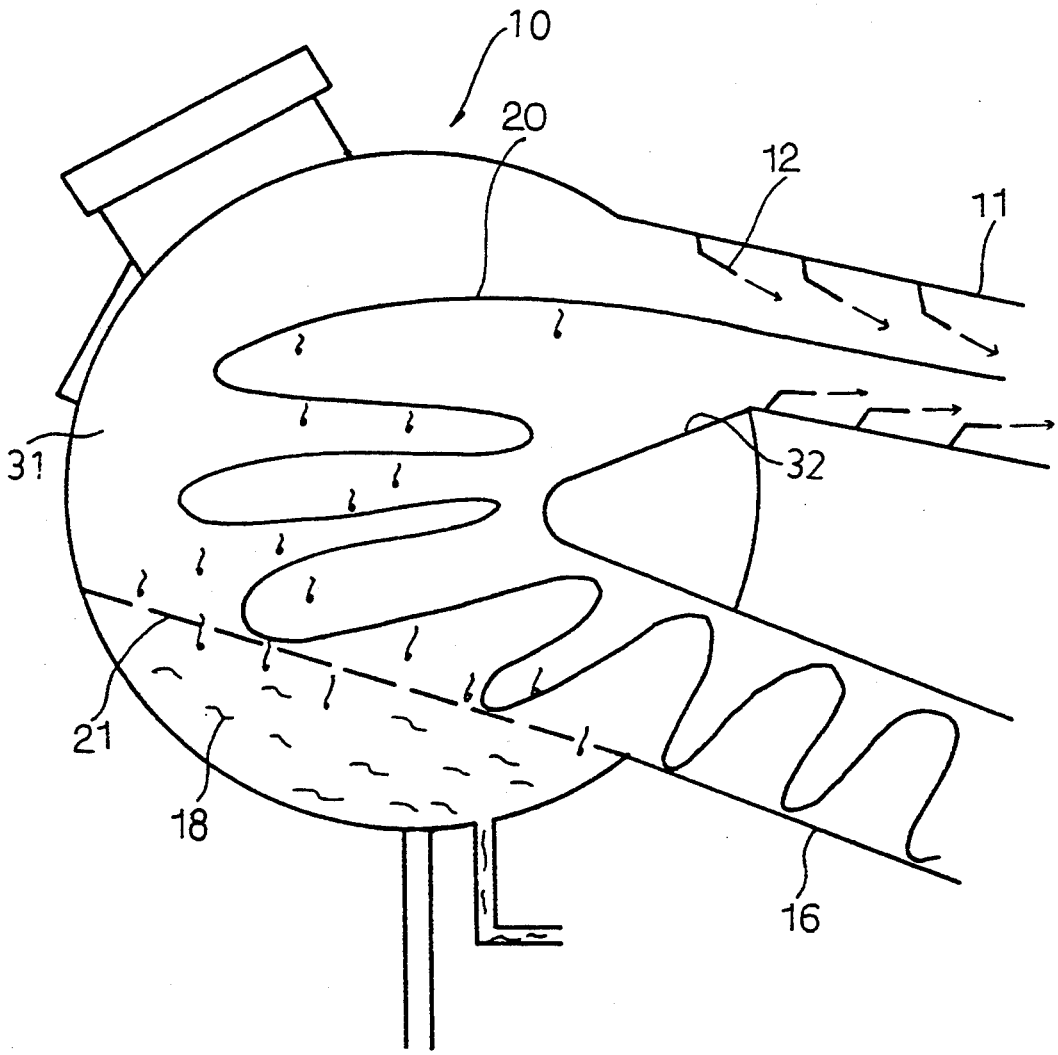
FIG. 2 is an enlarged view of the head portion.
Figure 3:
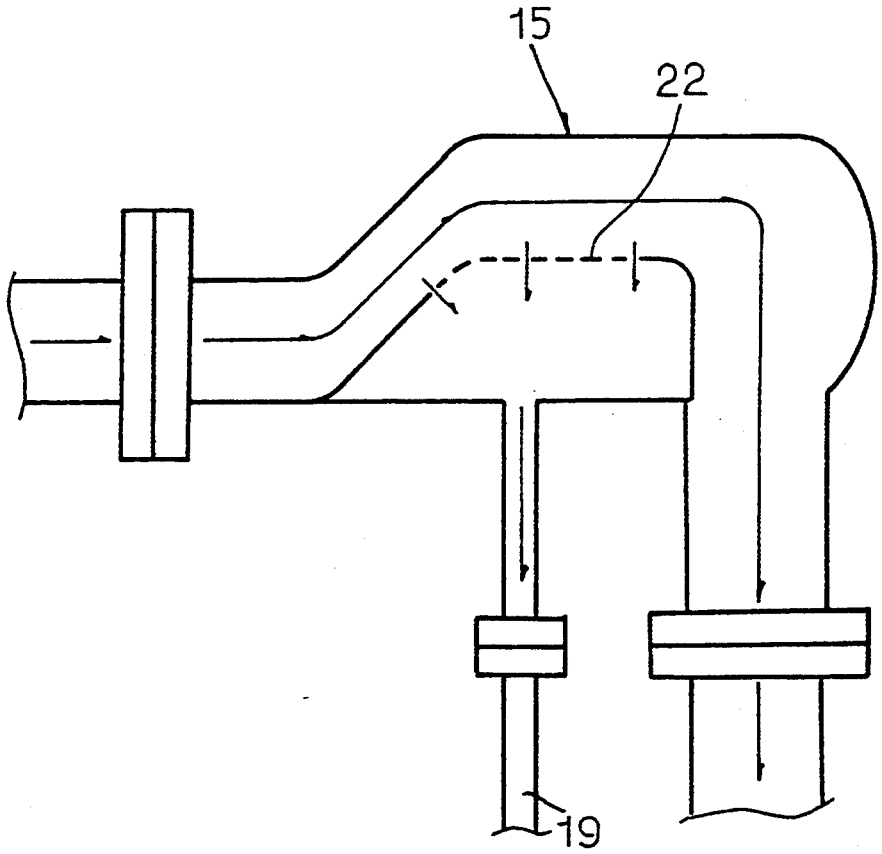
FIG. 3 is an enlarged view of the tail portion.
Figure 4:
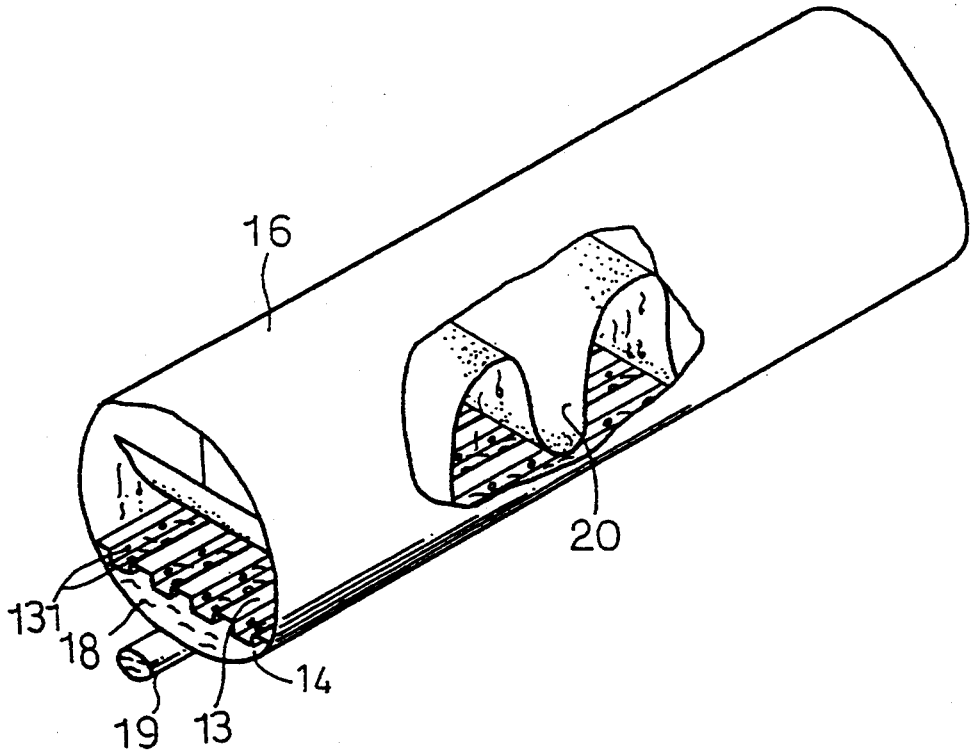
FIG. 4 illustrates the interior structure of the present invention.
Figure 5:
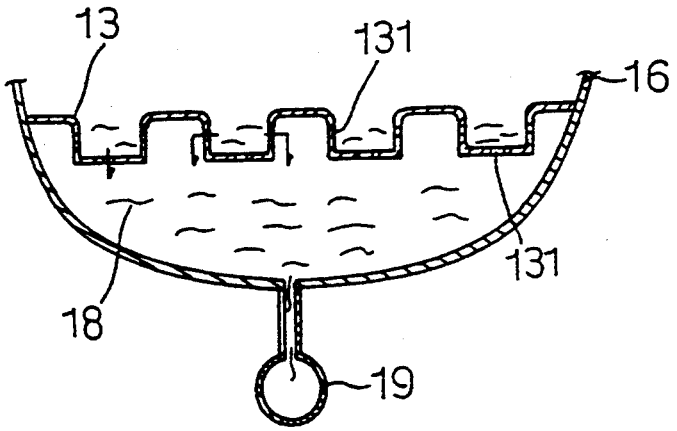
FIG. 5 is a sectional view of the present invention.

As shown in FIGS. 1 and 3, the outlet of the small tubular passage 11 is connected with the tail portion 15 which has an upper inlet extending upwardly and then vertically downwardly to form a lower outlet. Hence, the small tubular passage 11 is filled with dyeing liquid thus thoroughly dyeing the cloth 20 in advance. As the tail portion 15 first goes upwardly before extending downwardly, the vertical distance between the small tubular passage 11 and the large tubular passage 16 will be increased thereby providing a larger space for the cloth 20 and therefore preventing the cloth 20 from twisting together. In addition, the cloth 20 will be naturally stacked up in the large tubular passage 16 in order. Afterwards, part of the dyeing liquid flows down into the large tubular passage 16 through a filtering baffle 21 and the remaining part of the dyeing liquid goes down into the large tubular passage 16 together with the cloth 20. Then, the dyeing liquid 18 will flow downwardly on a perforated panel 13 through a filtering board 21. Thereafter, the dyeing liquid 18 will flow through the holes 131 of the perforated panel 13 into a reservoir 14. As the reservoir 14 is communicated with a branch pipe 19, the dyeing liquid will be collected therein. In the meantime, the dyeing liquid 18 will be forced to flow through the branch pipe 19 and the circular trough 31 to the nozzle 12 by a pump 17 thereby circulating the dyeing liquid (see FIGS. 4 and 5) in the dyeing machine.

The invention is naturally not limited in any sense to the particular features specified in the forgoing or to the details of the particular embodiment which has been chosen in order to illustrate the invention. Consideration can be given to all kinds of variants of the particular embodiment which has been described by way of example and of its constituent elements without thereby departing from the scope of the invention. This invention accordingly includes all the means constituting technical equivalents of the means described as well as their combinations.

I claim:

1. A dyeing machine without rollers comprising:

a circular trough having a neck portion at an upper portion thereof;

a tail portion, having an upper inlet, extending upwardly and then vertically downwardly to form a lower outlet;

a large tubular passage connected between a lower portion of said circular trough and the lower outlet of said tail portion;

a small tubular passage connected between the neck portion of said circular trough and the upper inlet of said tail portion;

a filtering board disposed on a bottom of said large tubular passage;

a perforated panel mounted under said filtering board;

a reservoir formed at a lower part of said large tubular passage and located under said perforated panel;

a branch pipe fitted under said reservoir and communicated therewith for collecting dyeing liquid; and a pump connected with the lower portion of said circular trough for circulating the dyeing liquid in said dyeing machine.

* * * * *